United States Patent [19]

Sendzimir

[11] 4,324,818

[45] Apr. 13, 1982

[54] PRODUCTION OF HEAVY METAL COATINGS ON ONLY ONE FACE OF STEEL STRIPS

[76] Inventor: Tadeus Sendzimir, 269 Brookside Rd., Waterbury, Conn. 06720

[21] Appl. No.: 123,275

[22] Filed: Feb. 21, 1980

[51] Int. Cl.[3] ..... B05D 1/12

[52] U.S. Cl. ..... 427/174; 427/181; 427/184; 427/191; 427/192; 427/205; 427/236; 427/239; 427/374.4; 427/376.8; 427/405; 427/427

[58] Field of Search ..... 427/174, 184, 191, 192, 427/181, 205, 224, 225, 236, 374.6, 374.4, 374.5, 376.8, 398.4, 398.5, 409, 422, 427, 437, 241, 406

[56] References Cited

U.S. PATENT DOCUMENTS

| | | | |
|---|---|---|---|
| 2,197,622 | 4/1940 | Sendzimir | 427/374.6 X |
| 2,198,253 | 4/1940 | Koehring | 427/205 X |
| 3,055,768 | 9/1962 | Lassiter | 427/225 |
| 3,231,971 | 2/1966 | McFarland et al. | 427/191 X |
| 3,428,472 | 2/1969 | Shimose et al. | 427/191 |
| 3,745,034 | 7/1973 | Smith et al. | 427/192 X |
| 4,061,801 | 12/1977 | Hamada et al. | 427/192 |

FOREIGN PATENT DOCUMENTS

| | | | |
|---|---|---|---|
| 51-79138 | 9/1976 | Japan | 427/406 |
| 886783 | 1/1962 | United Kingdom . | |

*Primary Examiner*—Shrive P. Beck
*Attorney, Agent, or Firm*—Samuel Lebowitz

[57] ABSTRACT

The production of a continuously advancing steel strip with a protective metal coating on only one face thereof by electrolytically depositing a thin primary coating of metal from an ionized metal salt bath onto said face, which is followed by a cleansing and drying thereof. Thereafter a predetermined quantity of coating metal in minute particulate form is deposited uniformly onto the coated face and is heated in a non-oxidizing atmosphere to fuse the particulate metal particles onto the thin primary coating followed by the sudden cooling thereof, while preventing the oxidation of the uncoated face during the fusing and cooling-off stages.

1 Claim, 8 Drawing Figures

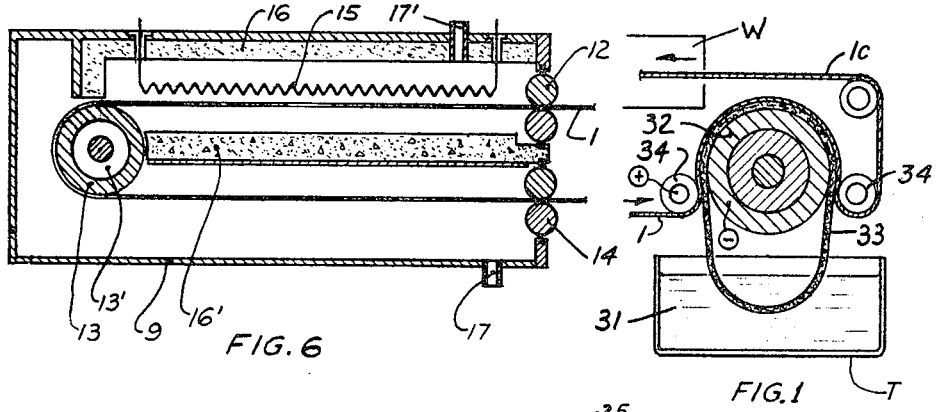
FIG. 6
FIG. 1
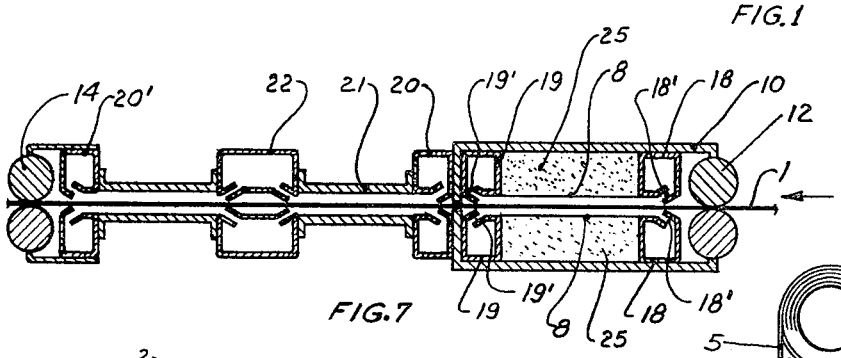
FIG. 7
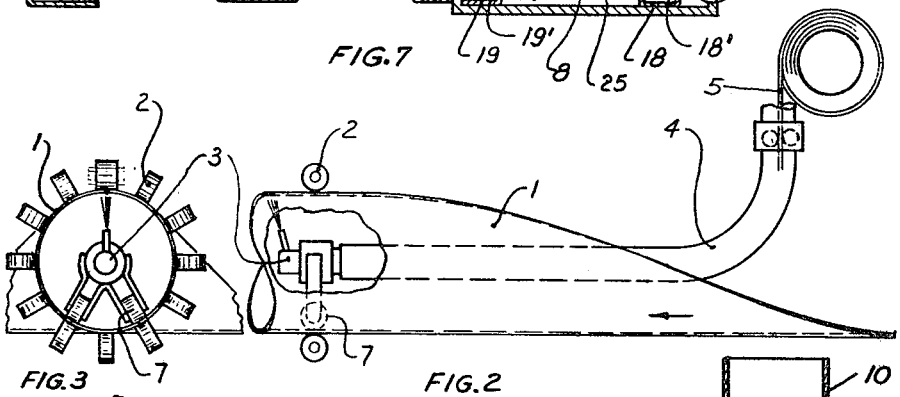
FIG. 3
FIG. 2
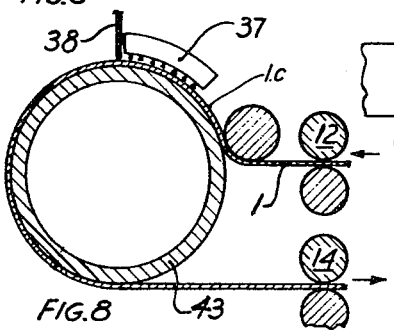
FIG. 8
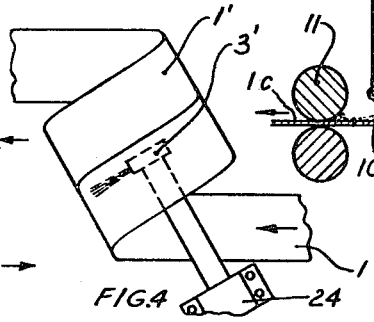
FIG. 4
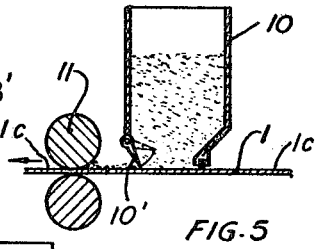
FIG. 5

PRODUCTION OF HEAVY METAL COATINGS ON ONLY ONE FACE OF STEEL STRIPS

The present invention relates to the production of heavy metal coatings on one face only of steel strips.

It is the object of the invention to improve upon the known methods of coating metals on one side only of ferrous base metal strips to attain a marked simplification and economy in production, and startling improvements in the quality of the products.

BACKGROUND OF THE INVENTION

Hot-dip metal coating processes for steel strips have been standardized all over the world for over three decades and are based on a process introduced by the applicant in the early thirties and now known as the Sendzimir process. It consists in preliminary light oxidation of the surface followed by reduction in a hydrogen-rich atmosphere, cooling to a temperature slightly above the temperature of the molten metal and finally passing it through the molten metal bath. Zinc and aluminum are the two coating metals that are used in practice and both sides of the strip are coated. To meet a recent demand for strips galvanized on one side only, several proposals have been made by practically every steel company, and they all represent methods of adopting their existing Sendzimir lines to produce one-sided coatings. The methods fall into two classes: (1) applying a protective coating to the face that must not be coated, such as metallic oxides with or without a dilicate binder. U.S. Pat. No. 3,383,250, May 14, 1968, is illustrative of those disclosing such methods; and (2) instead of dipping the strip into the molten bath, letting only one face of the strip touch it flat and relying upon capillary attraction to "wet" that face with the molten zinc. Improvements of this method, involving electric or ultrasonic stirring of the molten metal to produce an upward-directed wave to "wet" that one face more easily, have also been patented and apparently are in operation. Several patents showing such arrangements have been issued to Armco Steel Corporation, and U.S. Pat. No. 4,152,471, May 1, 1979, is illustrative of such.

The defects or disadvantages of the known processes arise from the fact that the face that is to remain blank requires expensive treatment for either (1) the removal of the protective coating, or (2) the removal of the iron oxide coating that forms on that surface when it is exposed to atmosphere at the temperature of molten zinc.

Another disadvantage is that such processes involve a fixed heat treatment preceding the zinc coating and it is not the best treatment for deep drawing sheets, which is the purpose for which the one-side-coated sheets are required. Neither can temper-rolling be performed with precision after zinc coating.

In order to overcome the above deficiencies and also to create a superior product, applicant has developed a process that cannot be practiced on a modified Sendzimir line but which is, to the applicant's best knowledge, entirely novel and which, in addition, results in further important advantages.

SUMMARY OF INVENTION

The process in accordance with the invention solves the problem of producing metallic coatings on one face of a steel strip, said coatings having practically any desired weight, from the lightest up to twice as heavy as e.g. hot-dip galvanized coatings which use an air knife to remove excess zinc.

Secondly, the process leaves the non-coated face blank and not oxidized.

Thirdly, the duration of the contact of the steel base with the coating metal can be limited to a fraction of a second and consequently, even on coating metals having a relatively high melting point such as aluminum, the alloy formation with steel base is almost totally non-existent.

Fourthly, although capable to be run at high industrial speeds such as 500 fpm, the process is adaptable to small units having a low speed which is a desirable feature for special coating applications for which there is no high tonnage demand.

Lastly, the second face of the steel strip can also be coated by the same process, provided the second coating metal has a lower melting point than the first one.

Electrolytic coatings on one or both sides of metallic strips for different purposes have been known for many years and the disclosures in U.S. Pat. Nos. 1,819,130, Aug. 18, 1931, to Smith; 3,483,098, Dec. 9, 1969, to Kramer; 3,483,113, Dec. 9, 1969, to Carter; and 3,523,067, Aug. 4, 1970, to Baird-Kerr et al, are illustrative of such. However, no one recognized the advantages of utilizing a thin primary coating of electrodeposited metal one one face of the metallic strip, as a base for a protective layer of metal, which layer is deposited in particulate form onto the former and fused thereto in situ by passage of the composite sheet through a heated non-oxidizing atmosphere at a temperature slightly higher than that required for melting the particles and fusing them to said "flash" primary coat, which after immediate cooling, forms a tenacious protective layer for the base with no undesirable alloying therewith. The composite sheet is kept in the non-oxidizing atmosphere until it is cooled down to a temperature that will not cause the oxidation of the clean face of the metallic strip, which in the case of a low carbon steel strip, is below 200° C.

Such flash coatings need not be deposited by passing an electric current. An alternate method is by sacrifician molecule exchange in contact with an aqueous solution of a salt of a nobler metal, containing some free acid. "Nobler" metal means a metal that is electropositive to another metal, iron in this instance. Most nobler metals that come into consideration here have a higher melting point than zinc or aluminum, and I find this alternate method particularly useful to obtain molten metal coatings of copper and cuprous alloys on steel. It is economical in the quantity of metal consumed because of its extreme thinness and the equipment is simple, requiring no electrical apparatus. The copper sulphate solution to which a few percent of sulphuric acid are added becomes ionized when in contact with the iron strip and that is the force which causes the molecule exchange to take place, and which occurs instantaneously. But the reaction is also self-limiting because the moment all iron molecules that were originally on the subject strip surface have been replaced by molecules of copper; the latter protect the iron molecules that are under the surface from being dissolved. And so we obtain a monomolecular "flash" coating ipso facto. When a layer of the main coating metal, say a 60–40 brass is sprayed on top of said flash coating and the strip is heated to slightly above the melting temperature of said brass under non-oxidizing conditions, said main coating fuses instantly with said flash coating and with the steel strip.

Such preliminary flash coating derived from an ionized salt bath may be of the same or different metal than the protective coating of fused metal particles. The latter may be spread uniformly onto the primary coat in dry powder form while the metallic strip is travelling in a horizontal plane or sprayed thereonto while the strip is temporarily distorted into a cylindrical contour to permit the distribution of the particles on the inner face of the strip rapidly and uniformly in any desired quantity. The metallic strip resumes its travel in a horizontal plane for passage through a non-oxidizing heated space, the coating particles become fused to the primary coat and base, which is followed by a sudden cooling to congeal the protective coating and to cool down the coated metallic strip to a temperature below that at which oxidation of the clear face of the strip may occur. The non-oxidizing atmosphere may be attained, if desired, by the use of reducing gases, and even with flames produced by reducing combustible gases, which gases are coursed in their encounter with the travelling metallic strip, to enhance the desired heating and cooling effects while maintaining a high rate of production of a high quality product.

The invention may be realized in many different ways, and several exemplary embodiments of such are illustrated in the accompanying drawings, wherein FIG. 1 is a sectional view of an electrolytic coating station for applying a primary coating to only one face of a travelling steel strip;

FIG. 2 is a front schematic elevation of an arrangement for deforming the coated steel strip into a cylindrical outline and spraying the inner surface thereof with a uniform layer of metal particles;

FIG. 3 is a left end view of FIG. 2;

FIG. 4 is a schematic plan view of a variant embodiment for deforming the horizontally travelling steel strip into a temporary cylindrical configuration to receive the sprayed metal particles;

FIG. 5 is a schematic front elevation of another embodiment of the invention which illustrates the spreading of the metal particles of the protective layer in powdered form onto the coated base issuing in a horizontal plane from the preliminary coating bath shown in FIG. 1;

FIG. 6 is a schematic longitudinal sectional view of a chamber for receiving the coated steel strip issuing from any of the embodiments shown in FIGS. 2 to 5, to heat and fuse the particles and to cool the coated strip;

FIG. 7 is a schematic longitudinal sectional view of an alternative embodiment from that shown in FIG. 6, for successively heating and cooling the coated steel strip; and FIG. 8 is a schematic vertical sectional view of another embodiment for successively heating the metal particles with combustible gaseous flames followed by the cooling of the composite sheet.

The process consists in first depositing on one face of a steel strip a "flash" coating of zinc or another suitable metal of low melting point following the known method of cleaning, pickling, raising, electroplating, washing and drying, substantially as described in the book "The Making, Shaping and Treating of Steel", published by U.S. Steel Co., 8th Edition, pages 808–809. However, in the instant case, the coating is only 1/20 and 1/10 as thick as conventional electrogalvanized coatings and mostly less than one percent of the final molten metal coating according to the present invention.

As shown in FIG. 1, after degreasing, a light pickle and rinse, the metal strip 1, such as e.g. the cold-rolled, annealed and temper-rolled low carbon steel strip is treated in the electro-plating tank T where strip 1 is passed around a cylindrical anode 32 made of the metal to be deposited, in this instance zinc, while it is separated from direct contact with it by a thin layer of electrolyte carried in a porous, absorbing, endless web 33, of felt or other absorbing material, which dips at every cycle in the electrolyte bath 31 to replenish itself. Guide rolls 34 press strip 1 against anode 32 to insure maintenance of the arc of contact which determines the time of contact and therefore, the quantity of metal deposited, while the other face of the strip is never in contact with the electrolyte.

The electrolytically coated steel strip with the "flash" coating uppermost passes through a washing and drying station W before proceeding to the principal coating station shown in FIG. 2.

In the following step, a predetermined quantity of the coating metal such as zinc, aluminum, etc. is uniformly deposited on the pre-coated surface of the strip. In the embodiment shown in FIGS. 2 and 3, the deposition is done with the aid of a gas-propelled liquid metal atomizer which, as is known in the art, deposits a uniform layer of the coating metal in small droplets.

In order to assure uniform deposition of metal across the strip and to prevent wastage over the edges, strip 1 with the pre-coated face uppermost, is passed through guides 2, FIG. 1, that form it into a tubular section with the two edges meeting each other on top, which then release them to permit the sheet to become flat again. At the precise point where the section of the strip is tubular, a rotating spray atomizer 3 with its axis disposed in the center of said tube, is provided to uniformly deposit the desired quantity of metal. The coating metal, (zinc, etc.), may be fed e.g. in the form of wire 5 through tube 4 to said atomizer. Parallel tubes (not shown) are used to feed (1) the combustion gas to melt said wire, and (2) air to support combustion and to spray it and to rotate the atomizer head 3 continuously while the structure is supported on wheels 7 to keep head 3 in the center of the tube.

A somewhat simpler embodiment is shown in FIG. 4. Strip 1 is deflected by suitable guides to form at least two full spiral convolutions 1' in juxtaposed relation to form a cylindrical surface, wherefrom the strip continues on a straight line for withdrawal to the next step. As shown in FIG. 4, the advancing and withdrawing paths of the steel strip are laterally spaced from each other. The convolutions form a cylindrical tube that also prevents any spilling of metal. The spraying nozzle 3', where pressured nitrogen is preferably used for atomization, is caused to rotate around an axis going through the center of said tube, by such means as gear motor 24. Molten coating metal is fed through said shaft from a tun dish or vat of molten metal (not shown).

Mechanical atomization instead of gas atomization may also be used, provided the deposition is uniform.

FIG. 5 shows an alternate method of spreading the coating metal which is here supplied in powder form to hopper 10 disposed on top of strip 1. An adjustable doctor blade 10' regulates the flow and finally the compacting driven roll 11 regulates the thickness of the powder layer and its uniformity. For a given metal, temperature and particle size, the layer thickness of the deposited powder will diminish with the diameter of said roll 11. In some cases I prefer to roughen the surface of said roll or even corrugate it to produce a heavier layer of the coating metal and it must be borne in mind that such type of irregularities in the thickness of the layer as caused by roll roughness or close corrugations are not objectionable since upon subsequent melting, the surface tension of the coating metal eliminates these irregularities to produce a smooth coating.

The coated strip then enters hood or chamber 9, FIG. 6, where a non-oxidizing atmosphere such as dry dissociated ammonia or other suitable gas, preferably a dry, hydrogen-containing gas, is passed in sufficient quantity so as to maintain therein a low dew-point atmosphere in spite of the inevitable leakages. Gas entry is preferably at 17, and exit at 17'.

The strip enters hood 9 preferably through a pair of pinch rolls 12, then around the cooling drum 13 and out again through exit pinch rolls 14. Both pairs of said pinch rolls are provided with drive means capable of exerting sufficient forces on the strip so that the length of strip comprised within hood 9 can be kept under tension, which tension must be strong enough to level out whatever waves, wrinkles or buckles the strip may contain.

Immediately following the entry of the strip 1 into the chamber 9 through the pinch rolls 12, the strip is intensely heated by suitable means such as high frequency induction or radiant heat from the resistors 15, as shown in FIG. 6, disposed close to, and parallel with, the top coated face 1*c* of the strip. The heat input should be accurately controlled so that all the deposited coating metal is fully molten, but is not heated by more than a few degrees above that temperature. Strip 1 should reach that temperature only a few inches before it contacts the cooling drum 13 where the coating metal is solidified instantaneously, the tension in the strip contributing to maintain a tight contact of the strip with said cooling drum. During the rest of the path around cooling drum 13, the strip loses most of its excess heat so that when it exits again into the ambient atmosphere through exit pinch rolls 14, its temperature is below oxidizing temperature, for example, around 200° C., at which temperature there is no danger of discoloration of the uncoated face of the steel strip.

The portion of hood 9 where heat is applied is preferably insulated as shown at 16, 16'.

Cooling fluid such as water is circulated through cooling drum 13, preferably through its aperture 13'.

As explained above, the deposited coating metal is located, while in molten state, on top of the heated steel strip which is strictly horizontal and is maintained flat by tension. Consequently, the deposited coating metal will melt and then solidify essentially in the same spot on the strip where it was originally deposited. Even if the quantity of the deposited metal is as much as twice or more as compared with maximum conventional heavyweight coating, the coating will solidify with a smooth surface without need of any air knife and the like.

The heat input can easily be controlled so that the length of time during which a steel strip is actually in contact with the molten coating metal and during which time an alloying action between the coating metal and steel may develop, can be limited to a small fraction of a second, especially when the steel strip is thin, for example, 0.020" to 0.030", because heat is quickly absorbed by contact with the cooling drum and the temperature is barely above the melting point of the coating metal.

FIG. 7 shows an alternate method of melting and cooling the coating metal, namely, by gas convection.

The heating chamber of hood 10 is essentially composed of top and bottom headers 18 to which suitably heated non-oxidizing gas is supplied under pressure. Said gas escapes from said headers by slots 18'. It moves at high velocity through the narrow passages parallel with strip 1 defined by top and bottom walls 8. The gas escapes through slots 19' provided in extracting headers 19, to be returned to the gas conditioning and heating pump disposed exteriorly (not shown), and is recirculated.

Heat insulating material 25 within the heating chamber 10 protects the strip travelling therethrough against undue heat loss until it reaches the cooling portion of the chamber which is similarly composed of the two feeding headers 20 discharging the cooling non-oxidizing gas through suitable slots to move in the same direction as the strip in the narrow passage between it and the walls 21, to extracting headers 22 which receive the gas through similar slots. Both headers are connected to the pumping station which conditions, cools and recirculates the non-oxidizing cooling gas.

The strip is kept under tension by suitable traction applied to pinch rolls 12 and 14, precisely as in the case of the embodiment shown in FIG. 6. This method of heating and cooling gives, in certain instances, a better control since the heat exchange between gas and the metal surface is rapid and so the heating gas need not be much hotter than the melting temperature of the coating metal, thereby positively excluding the danger of overheating. The same applies to cooling; the strip can be cooled down with precision to only a few degrees above the temperature of the cooling gas.

In very fast lines, as shown in FIG. 7, it is even possible to supply the cooling gas from feeding headers 20,20' disposed both at the hot and cold ends of the cooling portion of the hood with a single extracting header 22 in the middle, the reason being that the quick chilling of the molten metal is very necessary to prevent alloying but so is the necessity of preventing discoloration of the uncoated side of the strip and it will be cooled faster if freshly cooled gas contacts also the cold end directly.

The arrangement shown in FIG. 8 illustrates a variant embodiment of that shown in FIG. 6, which utilizes a different mode of heating for fusing the coating particles and thereafter suddenly cooling the coated strip. The coated surface 1*c* of strip 1 is rapidly heated by directly impinging closely spaced little flames from burners 37 disposed parallelly with said strip on its way up and around the top of the cooling pulley 43. The oxygen-to-gas ratio is designed to make the combustion atmosphere reducing to the coating metal at the existing temperature and other prevailing conditions. Baffle 38 which extends almost to the surface of strip 1, sharply cuts the flame action, so that the heat absorption by pulley 43 solidifies the molten coating metal instantly, especially when the strip is thin, for example, 0.020", where the tight contact with pulley 43 also protects the non-coated face of the strip from oxidation.

It must be pointed out that the layer of the coating metal is brought to melting temperature while situated on top of the base steel sheet, which in turn is in contact with the cooling pulley 43. This requires an enormous heat gradient which can only be achieved by the use of a gas mixture containing oxygen instead of air and a high-carbon gas such as acetylene or propane. But serious heat absorption by pulley 43 starts only when the opposite side of the base strip 1 becomes hot and heat transfer from such high temperature flames is so rapid that the whole heating cycle is very short. Consequently, even though the embodiment of FIG. 8 is not as economical in fuel consumption as the other two embodiments described above, the difference is not large.

CONCLUSION

Conventional hot-dip coating processes for steel strips require large "pots" for keeping the molten coating metal into which the strip dips obliquely downwards, then around the bottom deflector roll and finally vertically up and out, where the excess coating metal is blown away by so-called "air knives." Pots containing fifty tons of molten zinc are not uncommon. Submerged steel equipment including rotating parts such as rolls, are heavily attacked by the molten metal and are short-lived. Metals with higher melting points accentuate these conditions and aluminum or aluminum-silicon coating baths are the highest temperature hot-dip baths for steel strips that are industrially used today.

Compared with this, the subject process involves melting of minute quantities of the coating metal without using any "pot" or container, while spread over the steel strip. It can, therefore, be easily applied to coating metals having higher melting points, e.g. copper and its alloys such as bronzes and many other valuable coatings that could not be produced because of their high melting point.

The short period of contact with the molten metal also permits the coating line to run at considerably lesser velocities, even as low as 30 to 50 fpm, and still make possible the obtention of a good coating with not much alloy formation. Slow speed coating units are much less expensive to build than high capacity units, and there exists a great need for coated products involving new metal combinations to obtain special properties, but for which there is no big tonnage demand. The subject process can make production of those a reality.

I claim:

1. Process of continuously coating one face of a forwardly progressing ferrous strip with a main coating while preserving the opposite face clean and free from oxides, which comprises (a) cleaning said strip and depositing on said first-mentioned face a thin primary metallic coating of a metal capable of fusion with the main coating metal, to completely cover said face to a depth of at least one molecule, followed by washing and drying of said strip, (b) temporarily deflecting and guiding said strip into a substantially cylindrical outline with the pre-coated face innermost, (c) spraying said last-mentioned face uniformly with a predetermined quantity of the main coating metal in fine particulate form from a rotatable source of supply which is coaxial with said cylindrical outline, (d) pulling said coated strip under tension in a horizontal plane through a non-oxidizing atmosphere while applying heat thereto to melt said particles of said main coating metal and to effect the fusion of the latter with the metal of the underlying primary coating, (e) immediately thereafter applying cooling means to said strip so as to quickly solidify said molten layer of the main coating metal, (f) continuing to withdraw heat from said strip until it reaches a temperature below the oxidizing temperature for ferrous strips, and (g) removing said strip from said non-oxidizing atmosphere.

* * * * *